US006296515B1

(12) United States Patent
Daoud

(10) Patent No.: US 6,296,515 B1
(45) Date of Patent: Oct. 2, 2001

(54) CONNECTOR HAVING A LATCHING MECHANISM

(75) Inventor: Bassel H. Daoud, Parisppany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/515,653

(22) Filed: Feb. 29, 2000

(51) Int. Cl.[7] ..... H01R 4/24; H01R 4/26; H01R 11/20

(52) U.S. Cl. ..... 439/409

(58) Field of Search ..... 439/680, 676, 439/509, 409

(56) References Cited

U.S. PATENT DOCUMENTS 4,455,058 * 6/1984 Harner et al. ..... 439/409
5,667,402 * 9/1997 Denovich et al. ..... 439/409
5,681,182 * 10/1997 Reichle ..... 439/417
5,785,548 * 7/1998 Capper et al. ..... 439/409
5,971,795 * 10/1999 Daoud et al. ..... 439/409
5,989,054 * 11/1999 Fasce ..... 439/409
6,080,006 * 6/2000 Broder ..... 439/409
6,113,419 * 9/2000 Finley et al. ..... 439/418
6,123,566 * 9/2000 Daoud et al. ..... 439/409
6,152,760 * 11/2000 Reeser ..... 439/409

* cited by examiner

*Primary Examiner*—Brian Sircus
*Assistant Examiner*—Michael C. Zarroli

(57) ABSTRACT

A connector having a body and an insertion cap. The wire insertion cap is pivotable relative to the body and is positively and releasably engageable with the body by a latching mechanism. The latching mechanism includes inclined surfaces on the insertion cap on the body, which ensures that the insertion cap is retained in the connector body when a force is exerted on a wire retained within the insertion cap.

6 Claims, 6 Drawing Sheets

CONNECTOR HAVING A LATCHING MECHANISM

BACKGROUND OF THE INVENTION

1. Field of the Invention

The present invention relates to an insulation displacement connector for providing an electrical connection between insulated wires and a connector base. More particularly, the present invention relates to an insulation displacement connector having a latching mechanism that securely retains an insertion cap when wires held in the cap are pulled away from the connector.

2. Description of Background Art

Insulation displacement connectors typically include a wire insertion cap that is pivotable towards and away from a connector terminal. The connector terminal includes opposed metallic cutting surfaces for severing the insulation surrounding a wire held within the insertion cap when the insertion cap is pivoted towards the connector terminal. The connector terminal thereby becomes electrically conductive with the wire retained within the insertion cap. The connector terminal is plugged into an external device to complete a circuit including the wire, the connector, and the external device.

Conventional wire insertion caps are releasably connected to a connector body, and are therefore easily displaced from a connector terminal retained within the connector body when a force is exerted on a retained wire. It is often necessary to pull on wires retained within connectors in order to trace the origin of a particular wire, particularly when many wires are held in a bank of connectors. During a tracing operation, a technician pulls a wire from a remote location and detects movement of wires near the bank of connectors to verify the identity of the pulled wire. The force exerted on a wire in the circuit acts to pull the wire insertion cap retaining the wire away from the connector terminal of a connector. Once the insertion cap pivots away from the connector terminal, the wire is disengaged from the connector terminal and the circuit is opened or interrupted. This result is undesirable because it interrupts or terminates service to customers using the circuit.

A conventional solution to the above problem is a connector having a pivoting cap that is secured to a connector body by a screw. This connector is expensive because a screw must be included with the wire insertion cap and a threaded hole must be tapped into the connector body, which requires more material and additional steps to manufacture. In addition, connectors having screw caps are difficult and time consuming to use.

There is therefore a need in the art for a connector having a latching mechanism that securely latches an insertion cap to a connector body when a force is exerted on a wire retained in the connector, and that is easily disengageable with the connector body when removal of the wire is required.

SUMMARY OF THE INVENTION

The present invention satisfies the aforementioned need in the art by providing a connector having an insertion cap that is pivotable with respect to a connector body, in which the insertion cap and the connector body are positively and releasably engageable with one another by a latching mechanism. The insertion cap is positively engaged with the connector body by body latches on the connector body that are engageable with insertion cap latches on the insertion cap, the respective latches forming the latching mechanism.

The insertion cap includes two wire insertion ports for retaining insulated wires in the connector, and is pivotable away from and towards the connector body. The connector body includes terminals having insulation cutting portions which sever the insulation on the retained wires when the insertion cap is pivoted towards the connector body.

When the insertion cap is pivoted towards the connector body, each body latch engages a respective insertion cap latch. The body latches extend outwardly from the body to engage a corresponding recess in an insertion cap latch. Due to engaging inclined surfaces of the body latches and the insertion cap latches, a force on a wire retained in the insertion cap tightens the engagement between the engaged latches, and more securely holds the insertion cap in engagement with the connector body.

One insertion cap latch is disposed on each side of the insertion cap, and each insertion cap latch is engageable with a respective body latch on the body. The insertion cap includes a groove forming a gap in a face of the insertion cap. The groove allows the insertion cap latches to pivot about a pivot region adjacent to the groove in the insertion cap. When a force is exerted on an engagement surface of the insertion cap, the insertion cap latches pivot away from the body latches, disengaging the latches and allowing the insertion cap to pivot. Therefore, the insertion cap is easily engageable and disengageable with the connector body, and securely retains wires within the connector.

Further scope of applicability of the present invention will become apparent from the detailed description given hereinafter. However, it should be understood that the detailed description and specific examples, while indicating preferred embodiments of the invention, are given by way of illustration only, since various chances and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
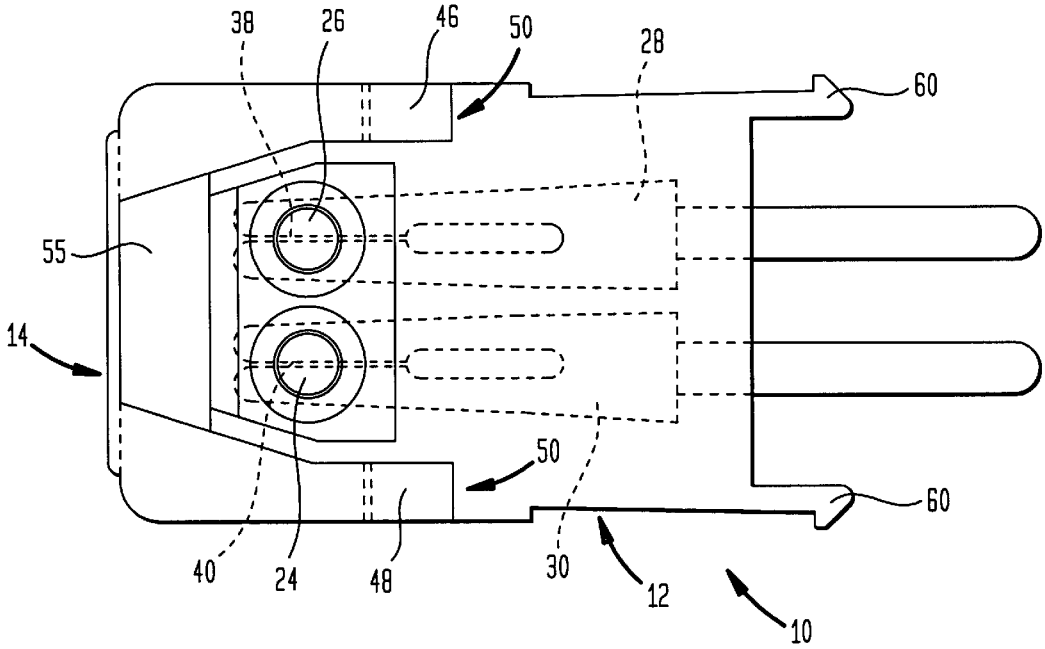
FIG. 1 is a plan view of a connector according to the present invention.
Figure 2:
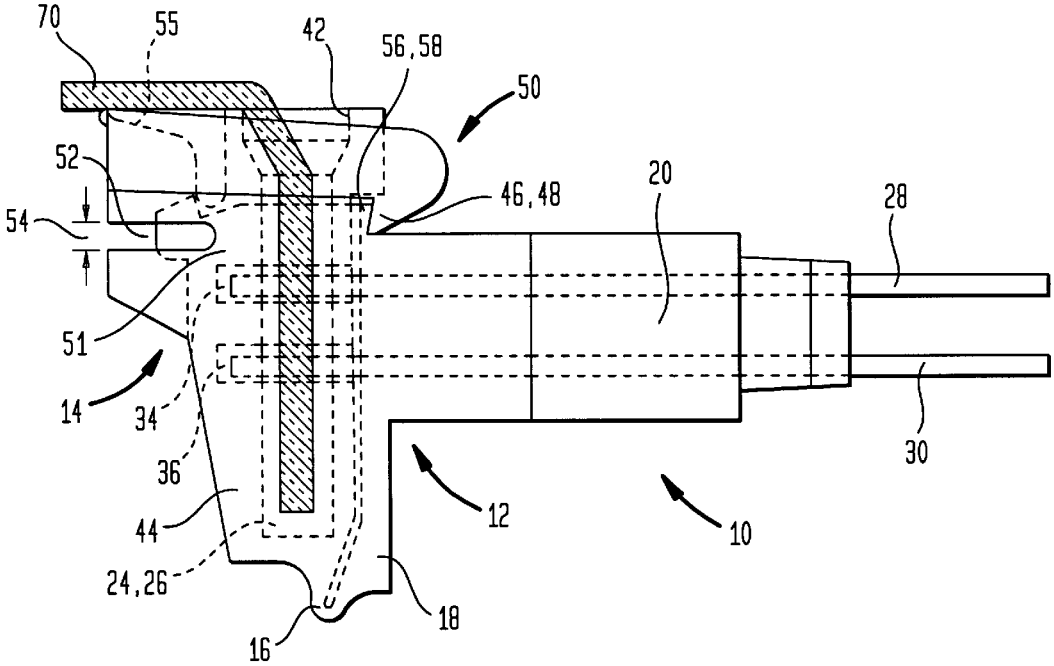
FIG. 2 is a side view of a connector according to the present invention.

Referring in detail to the drawings, with particular reference to FIGS. 1 and 2, a connector 10 is shown. The connector 10 includes a body 12 connected to an insertion cap 14 by a hinge 16. The insertion cap 14 is pivotable into and out of a receiving section 18 of the body 12. The receiving section 18 is integrally connected to a terminal section 20 of the body 12.

The insertion cap 14 includes two wire insertion ports 24, 26, each port being capable of receiving a wire 70 for electrical connection to one of two terminals 28, 30 extending through the terminal section 20. The terminals 28, 30 extend through the terminal section 20 of the body 12 and into the receiving section 18 of the body 12. When the insertion cap 14 is latched to the body 12, an end of each terminal 28, 30 projects into one of a respective terminal port 34, 36 formed in the insertion cap 14. Terminal port 34 opens into wire insertion port 26, and terminal port 36 opens into wire insertion port 24. By this arrangement, each of one of the terminals 28, 30 can be brought into electrical contact with a wire 70 disposed in a respective insertion port 24, 26.

As shown in FIG. 1, the terminal 28 includes an insulation cutting portion 38, and terminal 30 includes an insulation cutting portion 40, the insulation cutting portions having opposed sharp edges for slicing through insulation on a wire 70. The action of the insulation cutting portions 38, 40 exposes the terminals 28, 30 to the bare metal within a retained wire As shown in FIG. 2, wire insertion ports 24, 26 can have a large diameter portion 42 to provide for easier insertion of wires 70 into insertion cap 14.

The insertion cap 14 includes a base portion 44 that is pivotably connected to insertion cap latches 46, 48 by a pivot region 51. The pivot region 51 is formed by a groove 52 in the insertion cap 14, which leaves a gap 54 on one side of the insertion cap 14. When a force is applied at an engagement surface 55 of the insertion cap 14, the insertion cap latches 46, 48 pivot about pivot region 51 and disengage the insertion cap 14 from the body 12.

As shown in FIG. 2, insertion cap latches 46, 48 are engageable with body latches 56, 58 to secure the insertion cap 14 within the receiving section 18 of the body 12. The body latches 56, 58 and the insertion cap latches 46, 48 form a latching mechanism 50. Pivoting the insertion cap latches 46, 48 about pivot region 51 disengages the insertion cap latches 46, 48 from the body latches 56, 58.

The body 12 of connector 10 includes hooks 60 for mounting the connector 10 on a connector base. In this manner, terminals 28, 30 are electrically connected to circuitry within a connector base, thereby electrically connecting the wires 70 held within the insertion cap 14 with the circuitry of the connector base.

Figure 3:
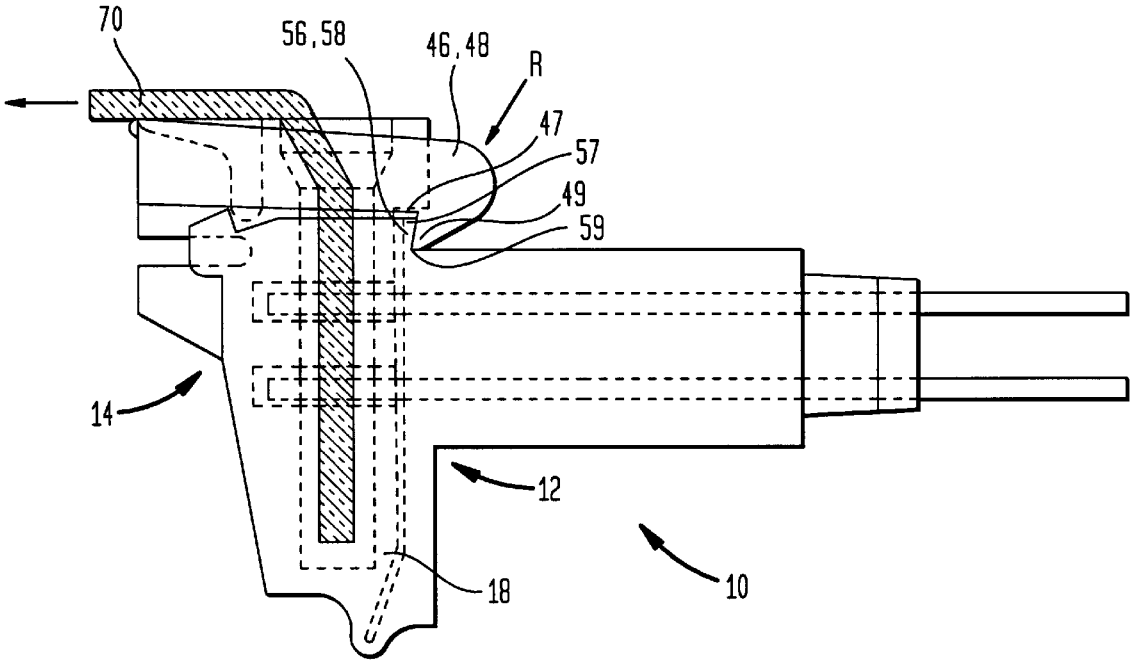
FIG. 3 shows a reaction force by the latching mechanism in response to a force on a retained wire.

FIG. 3 shows a resultant force R on the insertion cap 14 when a force is exerted on wire 70. When an end of the wire 70 retained in the insertion cap 14 is pulled away from the connector 10, the body latches 56, 58 exert the reaction force R on the insertion cap latches 46, 48, respectively. The resultant force R prevents pivoting of the insertion cap latches 46, 48 and therefore securely retains the insertion cap 14 within the receiving section 18 of the body 12.

The description of the respective latches will be described with respect to the body latch 56 and the insertion cap latch 46. The insertion cap 14 is securely retained by the acute interior angle formed by intersecting surfaces of the insertion cap latch 46 cooperating with the acute exterior angle formed by intersecting surfaces of the body latch 56. The body latch 56 includes a projection 57 at the acute exterior angle that extends into a recess 47 formed by the interior acute angle in the insertion cap latch 46. Likewise, a projection 49 of the insertion cap latch 46 projects into a recess 59 in the body latch 56. Only one of the projections 57, 49 need actually engage one of the recesses 47, 59 to secure the insertion cap 14. The insertion cap latch 48 and the body latch 58 also engage in this manner.

The body latches 56, 58 can include intersecting planar surfaces disposed at the above-mentioned acute angle to one another. The angle between the surfaces can be any angle which allows for ease of engagement and disengagement with the insertion cap latches 46, 48, while maintaining secure attachment of the insertion cap 14 with the body 12. The angle between the surfaces may advantageously deviate from 90 degrees by about 4 to 10 degrees. Likewise, the interior angle between surfaces of the insertion cap latches 46, 48 can be between 4 and 10 degrees less than 90 degrees. The amount that a projection extends into a respective recess can be increased or decreased according to the degree of positive engagement desired, the material of construction of the connector 10, etc.

The latch arrangement is particularly advantageous when a large number of wires are connected to a connector base via a large number of connectors. If a technician is tracing the location of wires in a system, such as in a telephone switchboard, a force exerted on the wire 70 in a connector 10 will not disengage an insertion cap 14 from a respective body 12. This prevents an interruption of telephone service to customers whose calls are transmitted through the connector 10.

Figure 4:
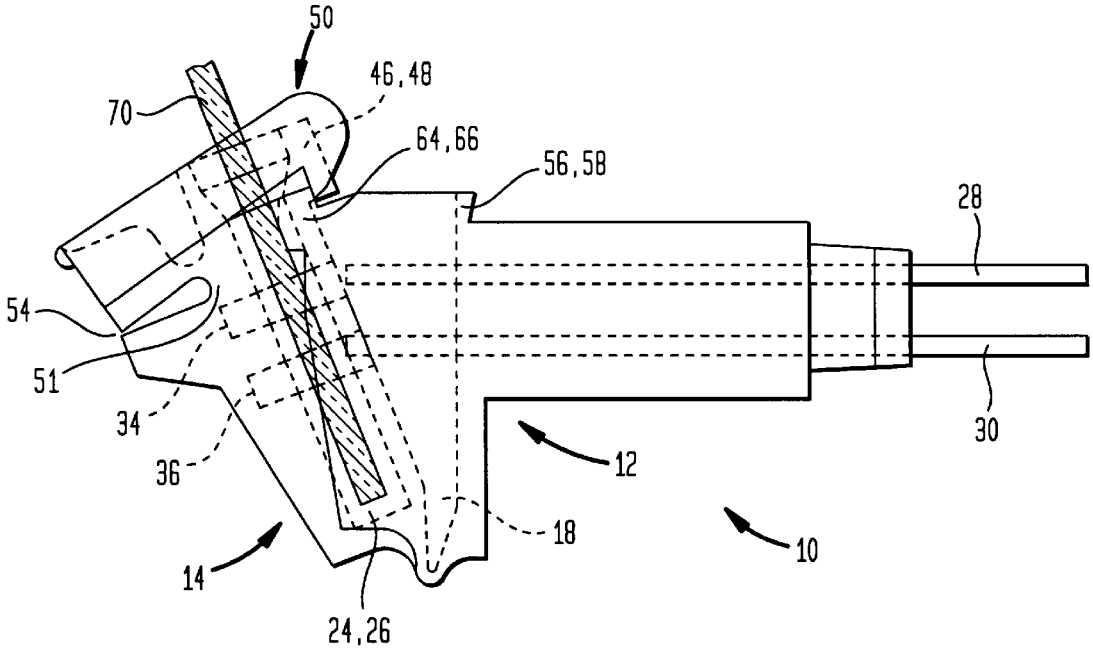
FIG. 4 shows the insertion cap pivoted away from the connector body.
Figure 5:
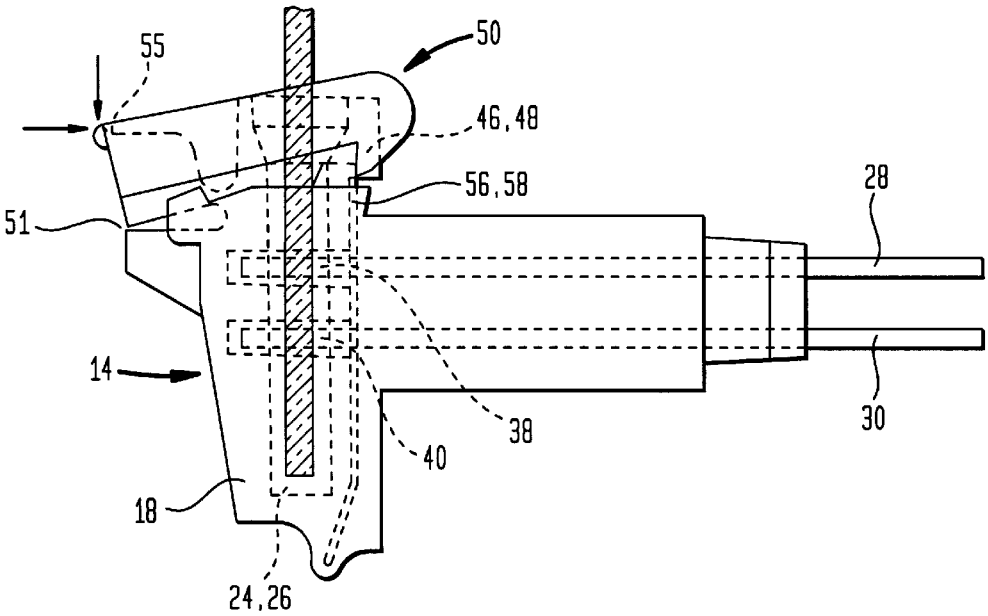
FIG. 5 shows closing forces exerted on the insertion cap.

FIGS. 4 and 5 show a wire insertion operation for the connector 10. In FIG. 4, the insertion cap 14 is pivoted away from the body 12. The insertion cap 14 is at its maximum pivot angle and is held within the receiving section 18 by engagement of pivot stops 64, 66 with a respective one of the insertion cap latches 46, 48. When the insertion cap 14 is in this position, the terminals 28, 30 are disengaged from the terminal ports 34, 36, respectively, allowing free translation of wires 70 within the wire insertion ports 24, 26.

As shown in FIG. 5, the insertion cap 14 may then be rotated into the receiving section 18, allowing terminals 28, 30 to enter the terminal ports 34, 36. If a wire 70 is disposed in the wire insertion port 24, the insulation cutting portion 40 will sever the insulation surrounding the wire 70, and the terminal 30 will become electrically connected to the wire 70. Insulation cutting portion 38 similarly acts on a wire retained within the wire insertion port 26. The arrows in FIG. 5 generally illustrate the forces required to close and engage the insertion cap latches 46, 48 with the body latches 56, 58. When these forces are exerted on the insertion cap 14, the gap 54 becomes partially closed as the insertion cap latches 46, 48 pivot about the pivot region 51.

As shown in FIGS. 4 and 5, wires 70 can be easily inserted into the insertion cap 14, and the insertion cap can be securely held within the body 12 without the use of tools or complicated manual operations.

Figure 6:
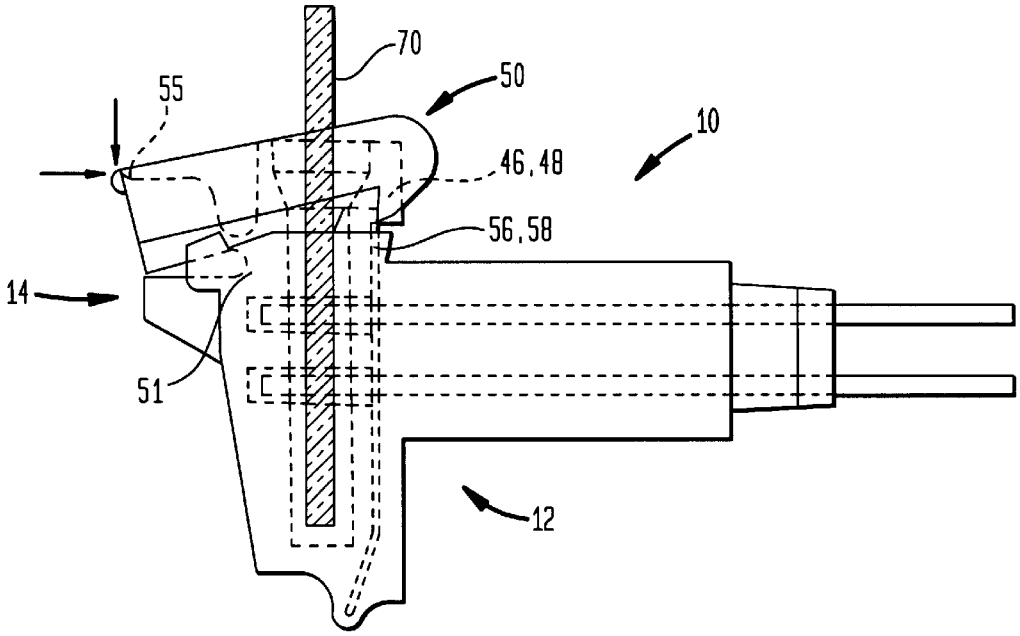
FIG. 6 shows disengagement of latches.
Figure 7:
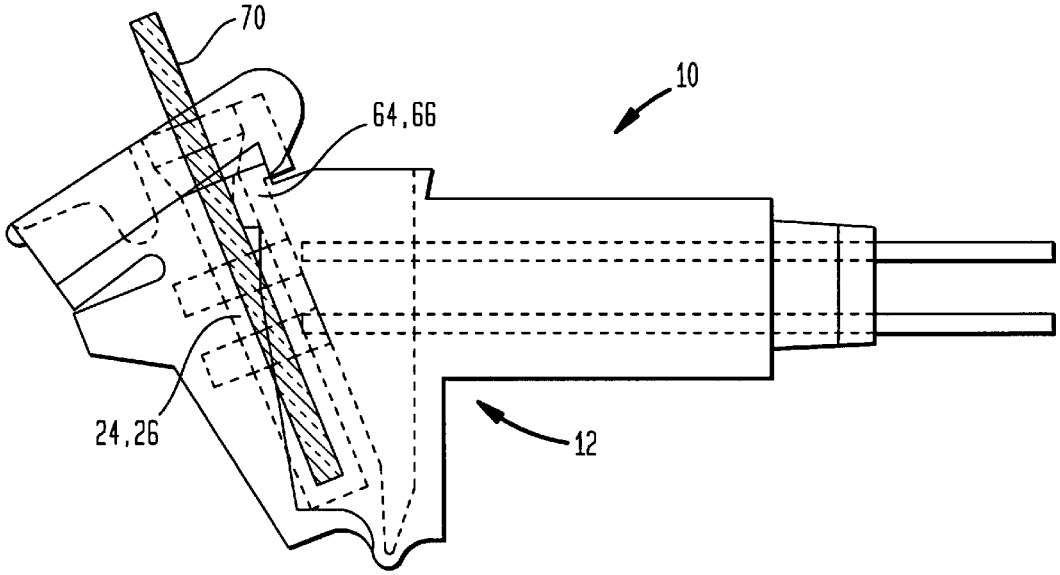
FIG. 7 shows the insertion cap pivoted away from the connector body.

FIGS. 6 and 7 show the removal of wires 70 from connector 10. When forces in the direction of the arrows in FIG. 6 are exerted on the insertion cap 14, the insertion cap latches 46, 48 pivot about the pivot region 51, and the insertion cap latches 46, 48 become disengaged with the body latches 56 58. As shown in FIG. 7, the insertion cap may then be pivoted away from the body 12 until it abuts the pivot stops 64, 66. Wires 70 may then be selectively removed from either of the wire insertion ports 24, 26.

Both the engagement or disengagement operation of the insertion cap 14 with the body 12 can be performed by an operator exerting the disclosed forces on the engagement surface 55 of the insertion cap 14.

Figure 8:
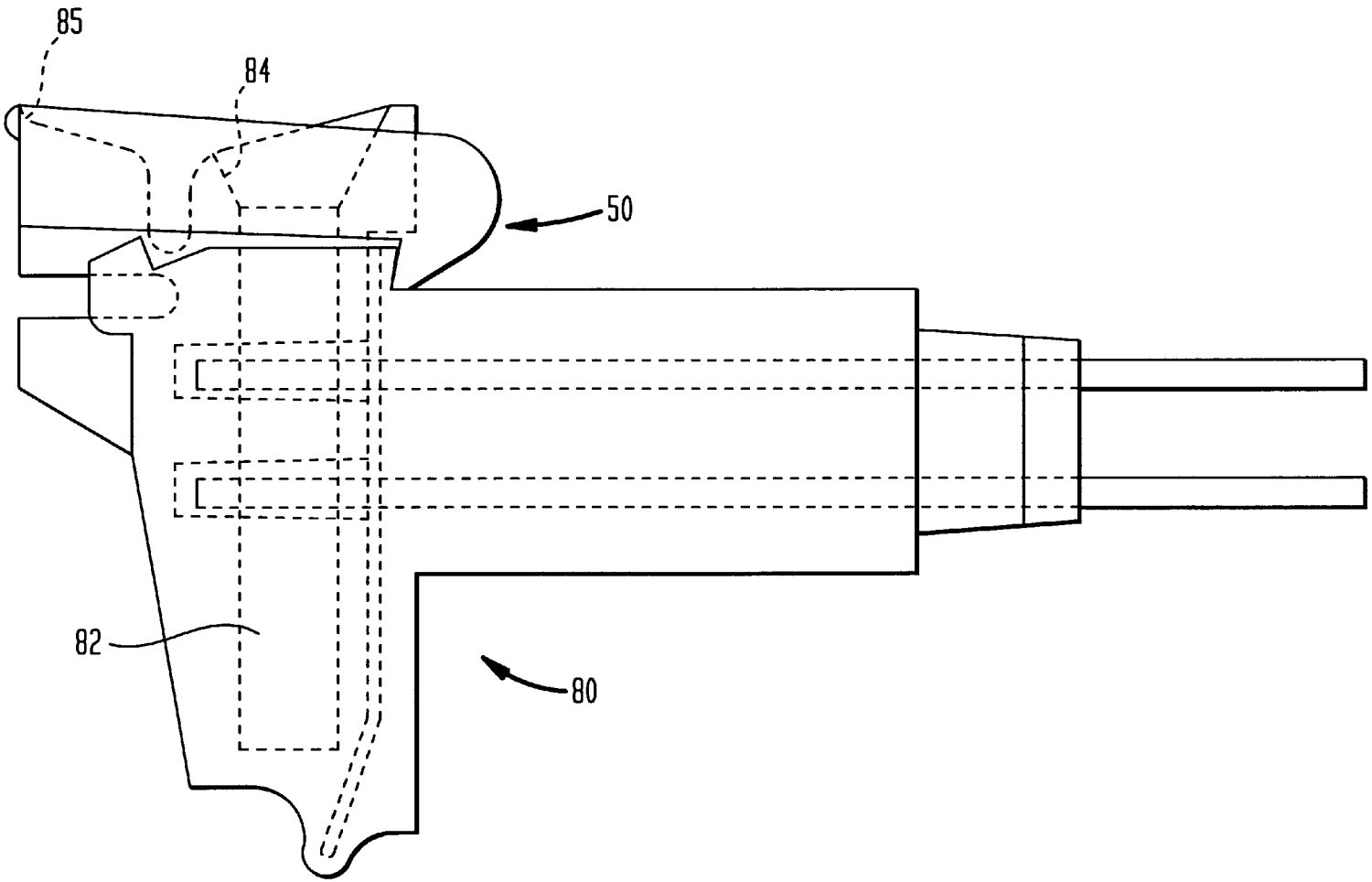
FIG. 8 is a side view of a variant of the connector according to the present invention.

FIG. 8 shows a variant of the connector 10 according to the present invention. In FIG. 8, a connector 80 includes a large diameter portion 84 of a wire insertion port 82. The opening of the large diameter portion 84 is angled to mate with an engagement surface 85. This shape allows for easier insertion of wires into wire insertion port 82.

Figure 9:
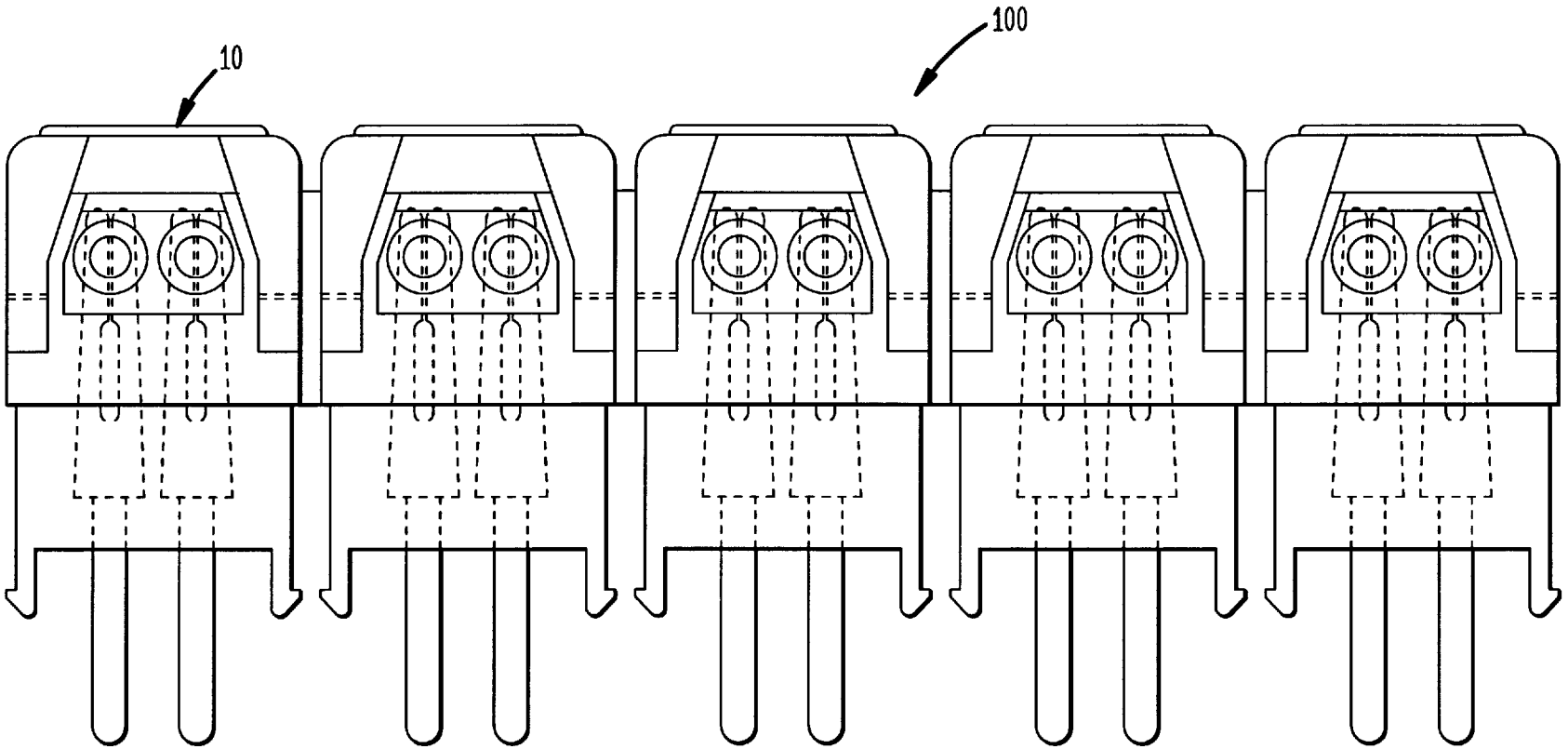
FIG. 9 shows a group of connectors according to the present invention.

FIG. 9 shows a group of five connectors 10. The connectors 10 can be joined in a block and inserted onto a connector base as a single unit 100.

The hinge 16 shown in the figures is a living hinge, which is integrally formed between the body 12 and the insertion cap 14. The inclusion of a living hinge 16 allows the connector to be formed by a single molding process. If a living hinge is included, connector 10 can be formed by any material having the required flexibility and having a living hinge characteristic. Material such as polypropylene or TR55 nylon are examples of such materials.

Alternatively, the insertion cap 14 and the body 12 can be formed separately, and joined by a mechanical hinge.

While the connectors 10 are discussed with reference to telephone connections, the connectors can be used in any environment where external wires are to be connected to a circuit or circuits by a connector.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connector comprising:

a body including, a terminal portion having a plurality of terminals extending therethrough, an insertion cap receiving portion having a recess, the recess extending substantially perpendicularly to the terminal portion, and a body latch disposed on the insertion cap receiving portion; and an insertion cap including, a base portion connected to the insertion cap receiving portion by a hinge, a wire insertion cap, the wire insertion cap being pivotable with respect to the base portion, a wire insertion port extending through the base portion, and an insertion cap latch disposed on the wire insertion cap, wherein the insertion cap is pivoted with respect to the body so that it extends partially out of said recess in the insertion cap receiving portion, and the insertion cap latch and the body latch are releasably engageable with one another to restrict relative motion between the body and the insertion cap, wherein the body latch includes two surfaces disposed at an acute angle to one another, and the insertion cap latch includes two surfaces disposed at an acute angle to one another.

2. The connector of claim 1, wherein the insertion cap latch includes a projection, the projection being extendable into said recess to engage the body latch and the insertion cap latch.

3. The connector of claim 1, wherein:

the insertion cap includes a second insertion cap latch, the insertion cap latches being disposed on opposite sides of the insertion cap; and the body includes a second body latch, the body latches being disposed on opposite sides of the body.

4. The connector of claim 1, wherein:

the insertion cap includes a plurality of wire insertion ports;

the insertion cap includes a plurality of terminal ports, each one of said plurality of terminals extending into one of said plurality of terminal ports when the body latch and the insertion cap latch are positively engaged, each terminal including an insulation cutting portion; and each terminal port opens into a respective one of said wire insertion ports in the insertion cap, and extends substantially perpendicularly to the wire insertion ports.

5. The connector of claim 1, wherein one of said body latch surfaces engages one of said insertion cap surfaces to engage the insertion cap with the body.

6. The connector of claim 1, wherein:

the wire insertion cap of the insertion cap is pivotable with respect to the base portion about a first axis;

the insertion cap is pivotable with respect to the body about an axis parallel to the first axis; and when the wire insertion cap of the insertion cap is pivoted with respect to the base portion, the insertion cap latch disengages the body latch, allowing the insertion cap to pivot away from the recess in the insertion cap receiving portion.

* * * * *